US006782214B2

(12) United States Patent
Hoberock et al.

(10) Patent No.: US 6,782,214 B2
(45) Date of Patent: Aug. 24, 2004

(54) FUSER SENSOR SYSTEM AND METHOD WITH MEDIA DETECTION

(75) Inventors: Tim M. Hoberock, Boise, ID (US); Michael J. Martin, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/612,078

(22) Filed: Jul. 2, 2003

(65) Prior Publication Data

US 2004/0096228 A1 May 20, 2004

Related U.S. Application Data

(63) Continuation of application No. 10/051,420, filed on Jan. 18, 2002, now Pat. No. 6,643,475.

(51) Int. Cl.[7] ..... G03G 15/00
(52) U.S. Cl. ..... 399/21; 399/22
(58) Field of Search ..... 399/21, 22, 67, 399/68; 219/216

(56) References Cited

U.S. PATENT DOCUMENTS

| | | | | |
|---|---|---|---|---|
| 5,506,667 | A | 4/1996 | Kinoshita | 399/21 |
| 5,659,867 | A | 8/1997 | Young | 399/330 |
| 5,848,319 | A | 12/1998 | Morigami et al. | 399/22 |
| 6,088,547 | A | 7/2000 | Martin et al. | 399/45 |
| 6,160,983 | A | 12/2000 | Hoberock et al. | 399/330 |
| 6,236,830 | B1 | 5/2001 | Hoberock et al. | 399/330 |
| 6,243,545 | B1 | 6/2001 | Jewell | 399/67 |
| 6,496,661 | B2 | 12/2002 | Ando et al. | 399/22 |
| 6,501,914 | B2 | 12/2002 | Yoshikawa | 399/22 |
| 6,643,475 | B2 * | 11/2003 | Hoberock et al. | 399/21 |

* cited by examiner

*Primary Examiner*—William J. Royer

(57) ABSTRACT

In one embodiment, an imaging device is provided that generates and transfers an image to a print media. A bias voltage is applied to a fuser to charge the fuser where the fuser bias voltage is affected by the print media contacting the fuser. An image is fused to the print media with the fuser and the fuser bias voltage is measured. Whether the print media is in the fuser can be determined based on the measured fuser bias voltage.

16 Claims, 6 Drawing Sheets

FUSER SENSOR SYSTEM AND METHOD WITH MEDIA DETECTION

CROSS REFERENCE TO RELATED APPLICATION(S)

This is a continuation of application Ser. No. 10/051,420 filed on Jan. 18, 2002 now U.S. Pat. No. 6,643,475, which is hereby incorporated by reference herein.

FIELD OF THE INVENTION

The invention relates to the electrophotographic imaging arts. It finds particular application to a method and system of sensing a voltage applied to a fuser. It will be appreciated that the present invention will find application in printers, copiers, facsimile machines or other electrophotographic imaging devices that fuse an image to a print media.

BACKGROUND OF THE INVENTION

In electrophotographic imaging devices, toner particles are used to form a desired image on print medium, which is usually some type of paper. Once the toner particles are applied to the paper, the paper is advanced along a paper path to a fuser. In many printers, copiers and other electrophotographic printing devices, the fuser includes a heated fusing roller engaged by a mating pressure roller. As the paper passes between the rollers, toner particles are fused to the paper through a process of heat and pressure.

Electro-mechanical sensors are typically mounted along the paper path to monitor the presence of the paper. When a paper jam occurs, the imaging device can locate or isolate the location of the paper based on the sensors. Typically, an electro-mechanical sensor is mounted before and/or after the fuser to determine whether the paper is in the fuser. Although it is helpful to know the location of the paper, each sensor adds cost to the imaging device.

The present invention provides a new and useful fuser sensing method and system.

SUMMARY OF THE INVENTION

In accordance with one embodiment of the present invention, an imaging device is provided that includes an image generation and transfer system that generates an image from toner particles and transfers the image to a print media. A fuser fuses the image to the print media and includes a fuser roller and a pressure roller in pressure engagement with the fuser roller where the print media passes in between. A bias voltage is applied to the fuser to reduce toner particles from being attracted to the fuser. A fuser sensor measures the bias voltage across the fuser and generates a status signal indicating whether the print media is in the fuser based on the measured bias voltage.

In accordance with another embodiment of the present invention, a method of determining a location of a print media within an electrophotographic imaging device is provided. The print media is moved through the imaging device while an image is generated and transferred to the print media. A bias voltage is applied to a fuser to charge the fuser where the fuser bias voltage is affected by the print media contacting the fuser. The image is fused to the print media. The fuser bias voltage is measured and it is determined whether the print media is in the fuser based on the measured fuser bias voltage.

One advantage of the present invention is that an imaging device can determine if a sheet of print media is in the fuser by measuring the bias voltage of the fuser.

Still further advantages of the present invention will become apparent to those of ordinary skill in the art upon reading and understanding the following detailed description of the illustrated embodiments.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of this invention.

DETAILED DESCRIPTION OF ILLUSTRATED EMBODIMENT

The following includes definitions of exemplary terms used throughout the disclosure. Both singular and plural forms of all terms fall within each meaning:

"Image", as used herein, includes but is not limited to any form of data representing an image that is to be generated and/or transferred to a print media during a printing process. Image includes any type of printable or printed markings such as characters, text, graphics or any combination of these.

"Signal", as used herein, includes but is not limited to one or more electrical signals, analog or digital signals, one or more computer instructions, a bit or bit stream, or the like.

"Software", as used herein, includes but is not limited to one or more computer executable instructions, routines, algorithms, modules or programs including separate applications or code from dynamically linked libraries for performing functions and actions as described herein. Software may also be implemented in various forms such as a stand-alone program, a servlet, an applet, instructions stored in a memory or other logic device, part of an operating system or other type of executable instructions. It will be appreciated by one of ordinary skill in the art that the form of software is dependent on, for example, requirements of a desired application, the environment it runs on, and/or the desires of a designer/programmer or the like.

"Logic", as used herein, includes but is not limited to hardware, firmware, software and/or combinations of each to perform a function(s) or an action(s). For example, based on a desired application or needs, logic may include a software controlled microprocessor, discrete logic such as an application specific integrated circuit (ASIC), or other programmed logic device. It will be appreciated that logic may be fully embodied as software or by functionally equivalent circuits and vise versa.

Figure 1:
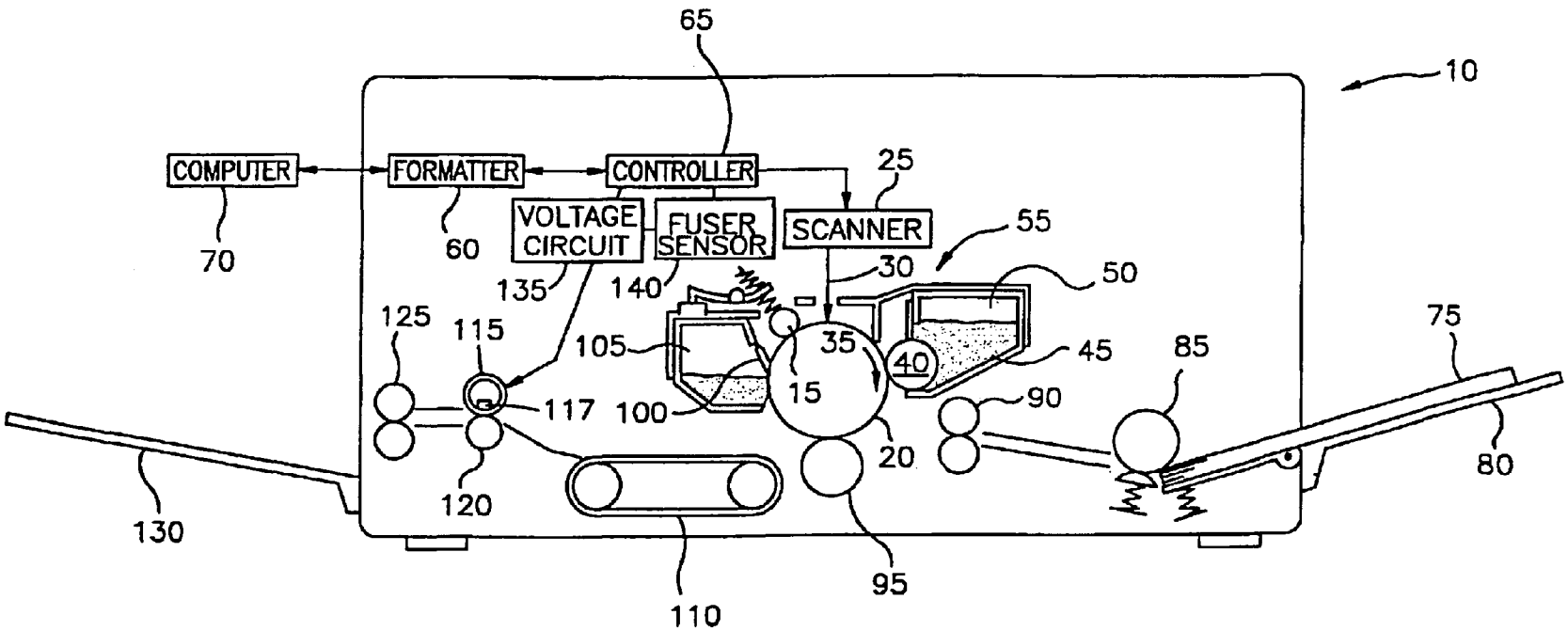
FIG. 1 is an exemplary simplified system diagram of an imaging device having a sensor system in accordance with one embodiment of the present invention.

Illustrated in FIG. 1 is a simplified cross sectional view of an exemplary electrophotographic imaging device, such as an electrophotographic printer 10, in accordance with one embodiment of the present invention. The printer 10 includes, for example, a charge roller 15 that charges the surface of a photoconductor, such as an organic photoconductor drum 20, to a predetermined voltage. A laser scanner 25 includes a laser diode (not shown) that emits a laser beam 30 onto the photoconductor drum 20 to selectively discharge its surface. The laser beam 30 is reflected off a multifaceted spinning mirror (not shown) that reflects or "scans" the laser beam 30 across the surface of the photoconductor drum 20 forming a latent electrostatic image corresponding to data being printed. The photoconductor drum 20 rotates in a clockwise direction as shown by the arrow 35 such that each successive scan of the laser beam 30 is recorded on the photoconductor drum 20 after the previous scan.

To this end, the embodiment of the electrophotographic imaging device shown in FIG. 1 includes a software configured processing device, such as formatter 60 and controller 65. Alternatively, the electrophotographic printer 10 could use other processing devices such as a microprocessor, discrete logic or other digital state machines. To form the latent electrostatic image, the formatter 60 receives data, including print data (such as, a display list, vector graphics, or raster print data) from an application program running on a computer 70. The formatter 60 converts the print data into a stream of binary print data that is an electronic representation of each page to be printed, and sends it to the controller 65. The controller 65 supplies the stream of binary print data to the laser scanner 25 causing the laser diode to pulse in accordance with the data, thus creating the latent electrostatic image on photoconductor drum 20. In addition, the formatter 60 and controller 65 exchange data necessary for controlling the electrophotographic printing process as known in the art for a particular imaging device.

With further reference to FIG. 1, after the surface voltage of the photoconductor drum 20 has been selectively discharged, a developing device, such as a developing roller 40, transfers toner 45 to the surface of the photoconductor drum 20. Toner 45, for example, is stored in a toner reservoir 50 of a toner print cartridge 55. A magnet (not shown) located within the developing roller 40 magnetically attracts the toner 45 to the surface of the developing roller 40. As the developing roller 40 rotates, the toner 45 is electrostatically transferred from the developing roller 40 to the discharged surface areas on the photoconductor drum 20 thus covering the latent electrostatic image with toner particles.

A print media 75, such as paper, envelopes, transparencies and the like is loaded from a media tray 80 by a pickup roller 85 and travels in a printing path in the electrophotographic printer 10. The print media 75 moves through drive rollers 90 so that the arrival of the leading edge of the print media 75 at a transfer point below the photoconductor drum 20 is synchronized with the rotation of the latent electrostatic image on the photoconductor drum 20. There, an image transfer device, such as a transfer roller 95, charges the print media 75 so that it attracts the toner particles away from the surface of the photoconductor drum 20. As the photoconductor drum 20 rotates, the toner 45 adhered to the discharged areas contacts the charged print media 75 and is transferred thereto.

The transfer of toner particles from the photoconductor drum 20 to the surface of the print media 75 is not always complete and some toner particles may remain on the photoconductor drum 20. To clean the photoconductor drum 20, a cleaning blade 100 may be included to remove non-transferred toner particles as the photoconductor drum 20 continues to rotate and the toner particles are deposited in a toner waste hopper 105. The photoconductor drum 20 may then be completely discharged by discharge lamps (not shown) before a uniform charge is restored to the photoconductor drum 20 by the charge roller 15 in preparation for the next image generation and toner transfer. In general, the image generation and transfer system of the electrophotographic printer 10 includes the laser scanner 25, the photoconductive drum 20, a drum charging device such as the charge roller 15, a toner transfer device such as the developing roller 40, and an image transfer device such as the transfer roller 95. It will be appreciated that other components can be characterized as part of the system including every component in the image device 10 since each plays a role in the image generation and transfer to the print media 75.

As the print media 75 moves in the printing path past the photoconductor drum 20 and the transfer roller 95, it enters a post transfer area. There, a conveyer 110 delivers the print media 75 to a fixing device, such as a heated fuser roller 115 and a heated pressure roller 120, generally referred to herein as a fuser. The rollers 115, 120 are in pressure engagement with each other and form a nip at their contact point. As the print media passes between the rollers 115, 120 through the nip, the toner 45 is fused to the print media through a process of heat and pressure. One or both rollers 115, 120 are motor driven to advance the print media 75 between them. In one embodiment, the fuser is an on-demand fuser and the fuser roller 115 includes, for example, a flexible rotating sleeve that surrounds a carrier which holds a ceramic heating device 117. The carrier provides structure to the fuser roller 115 so that pressure may be applied against the pressure roller 120. The flexible sleeve is typically made of polyimide. Alternately, the fuser roller 115 can be a hard roller constructed with a hollow metal core and an outer layer often made of a hard "release" material such as a Teflon® film.

The heating device 117, such as a ceramic heating strip, is positioned inside the fuser roller 115 and along its length. The heating strip can be silver based with a glass cover to reduce friction with the fuser roller 115. Other heating devices may include a quartz lamp, heating wires or other suitable heating elements as known in the art. The pressure roller 120 is, for example, constructed with a metal core and a pliable outer layer. The pressure roller 120 may also include a thin Teflon® release layer (not shown). After fusing the toner 45 to the print media 75, output rollers 125 push the print media 75 into an output tray 130 and printing is complete.

With further reference to FIG. 1, a voltage circuit 135 applies a bias voltage to the fuser roller 115 to keep toner particles from attaching to the fuser roller 115 when the print media 75 is passing through it. The bias voltage is applied at substantially a constant value, for example, −600 volts. It will be understood by those skilled in the art that the applied voltage can be other values and will change depending on the type of toner 45 used for printing. For example, when using a negative sign toner, the applied bias voltage is a negative voltage so that the toner is repelled from the fuser. When using a positive sign toner, the applied bias voltage is a positive voltage.

Although the bias voltage is applied at a constant voltage value, the voltage of the fuser does not remain constant. The fuser voltage changes as the print media 75 contacts the fuser. Most types of print media 75 are electrically non-conductive and once it contacts the fuser, it enters the current path and changes the electrical properties of the system. In general, the print media 75 increases the capacitance of the system which causes a change in the fuser voltage. In other words, the presence or absence of the print media 75 in the fuser causes the fuser to have different voltage states, for example, a non-fusing voltage state and a fusing voltage state. To monitor and measure the voltage across the fuser, a fuser sensor circuit 140 is connected to the voltage circuit 135. By monitoring the bias voltage on the fuser roller 115, the electrophotographic printer 10 can determine whether the print media 75 is in the fuser or not. This will be described in greater detail below and with reference to FIG. 2.

With continued reference to FIG. 1, the controller 65 also controls a high voltage power supply (not shown) to supply voltages and currents to components used in the electrophotographic processes, such as to the charge roller 15, the developing roller 40, the transfer roller 95 and the fuser. Furthermore, controller 65 controls a drive motor (not shown) that provides power to a gear train (not shown) and controls various clutches and paper feed rollers necessary to move the print media 75 through the printing path within the electrophotographic printer 10. It will be appreciated that different imaging devices may have components and control mechanisms different than those shown in the exemplary system of FIG. 1. One of ordinary skill will appreciate that the present invention will apply to other devices in accordance with their particular configuration and obvious modifications thereto.

Figure 2:
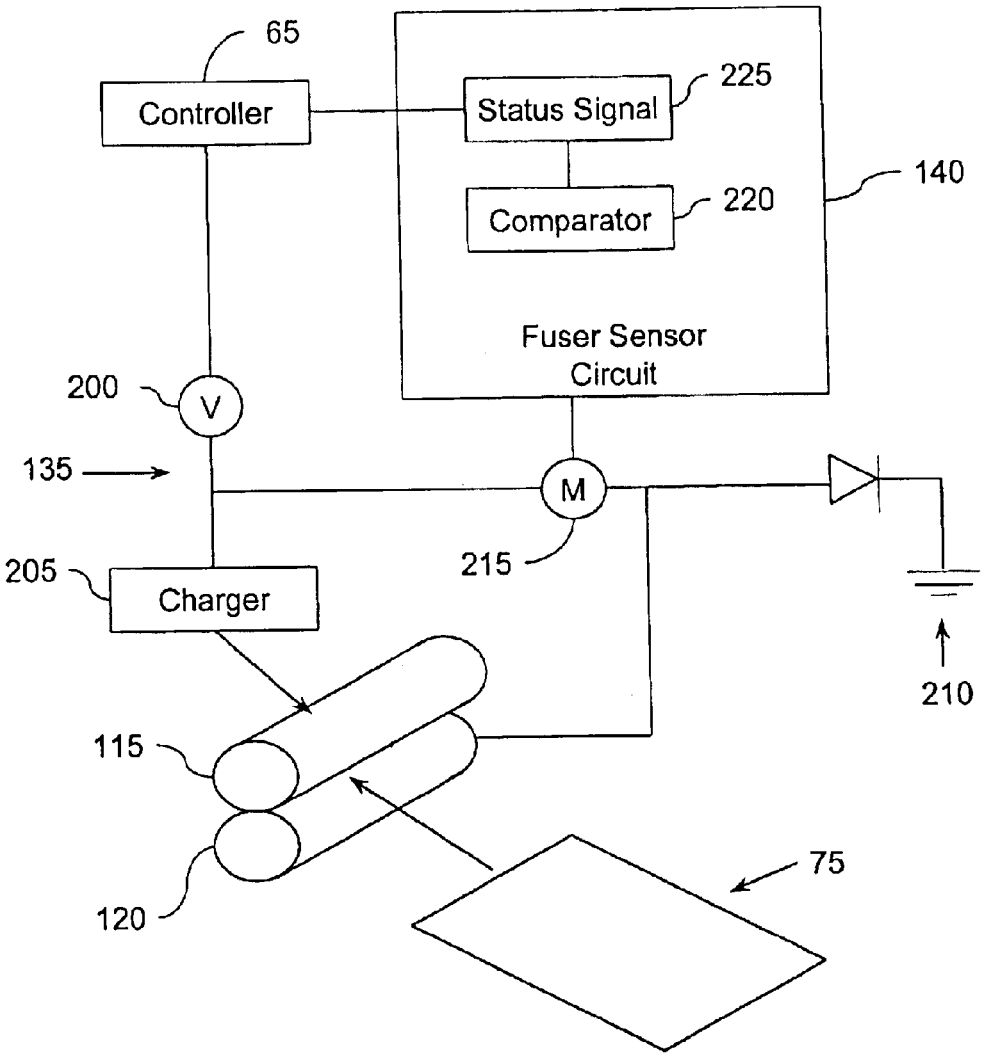
FIG. 2 is an exemplary fuser system and sensor circuit in accordance with one embodiment of the present invention.

With reference to FIG. 2, one embodiment of the voltage circuit 135 and the fuser sensor circuit 140 is shown in an exemplary configuration with the fuser roller 115 and pressure roller 120. As stated previously, the voltage circuit 135 applies a generally constant bias voltage to the fuser. For example, the voltage circuit 135 includes a voltage power source 200 that applies a negative voltage to the fuser roller 115 through a charger 205. The charger 205 is an electrically conductive device that is in contact with the fuser roller 115. For example, the charger 205 is a charge brush having fibers of electrically conductive material that contact the fuser roller 115 and charge it according to the bias voltage. The voltage circuit 135 is also electrically connected to the pressure roller 120 and the voltage circuit 135 is grounded at 210. The voltage circuit 135 is connected to the shaft of the pressure roller 120 or contacts other areas of the pressure roller 120 using other electrical contact devices as known in the art.

As described above, the bias voltage is applied to the fuser to keep toner particles from attaching to it. The bias voltage depends on the sign of the toner 45 (e.g. the bias voltage is negative for a negative sign toner, and positive for a positive sign toner.) An exemplary bias voltage may be about −600 volts when printing with a negative sign toner. Of course, other voltages can be used.

With further reference to FIG. 2, as the print media 75 enters the fuser or otherwise comes in contact with the nip between the fuser roller 115 and the pressure roller 120, the print media 75 changes the electrical properties of the fuser. Thus, the print media 75 changes the bias voltage of the fuser. The fuser sensor circuit 140 is connected to the voltage circuit 135 at a measuring point 215 to monitor and measure the bias voltage across the fuser. In the illustrated embodiment, the measuring point 215 is located on the signal line between the charger 205 and the ground 210. Of course, it will be appreciated that other circuit configurations can be used. For example, the voltage can be measured directly from the fuser roller 115 or the pressure roller 120. Using the fuser sensor circuit 140, the controller 65 can determine whether the print media 75 is in the fuser or not by detecting a change in the measured bias voltage and/or analyzing the measured bias voltage. This information is useful when a paper jam occurs since it assists the imaging device to locate the paper and to generate an appropriate error signal.

In one embodiment, the fuser sensor circuit 140 includes a comparator logic 220 that has a reference voltage set to the applied bias voltage. The comparator logic 120 compares the measured bias voltage to the reference voltage and a difference value is computed. When the difference value passes a predetermined threshold value, the comparator logic 220 generates and stores a status signal 225 by, for example, setting a bit value. The status signal 225 indicates to the controller 65 that print media 75 is in the fuser. Alternately, the fuser sensor circuit 140 can use edge detection logic that detects changes in the measured bias voltage and sets the status signal 225 accordingly. In this case, the comparator logic 120 keeps track of whether the edge is a leading or trailing edge in the measured voltage such that the corresponding change in voltage properly indicates that print media 75 is in the fuser.

Figure 3:
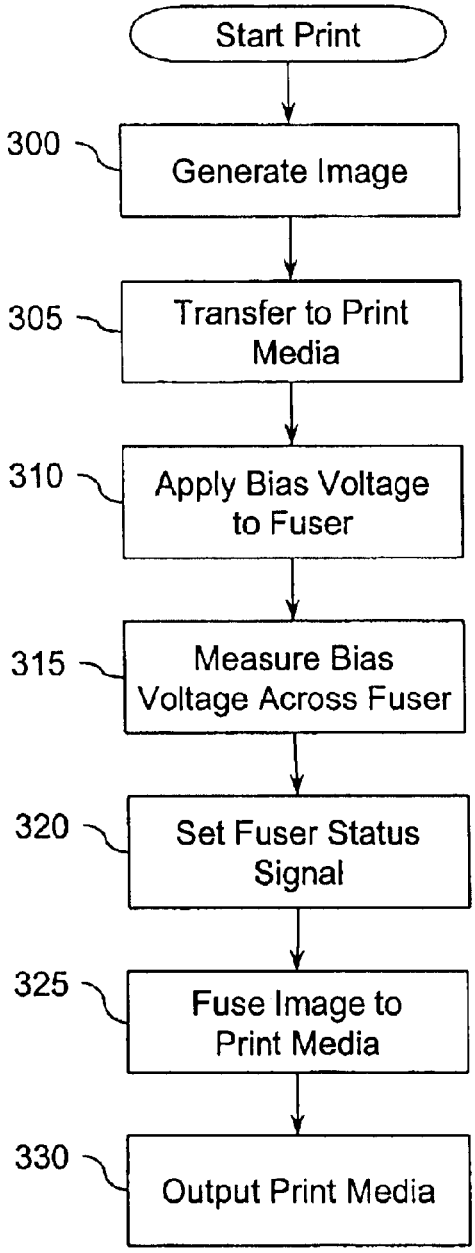
FIG. 3 is an exemplary methodology of printing an image in accordance with one embodiment of the present invention.
Figure 4:
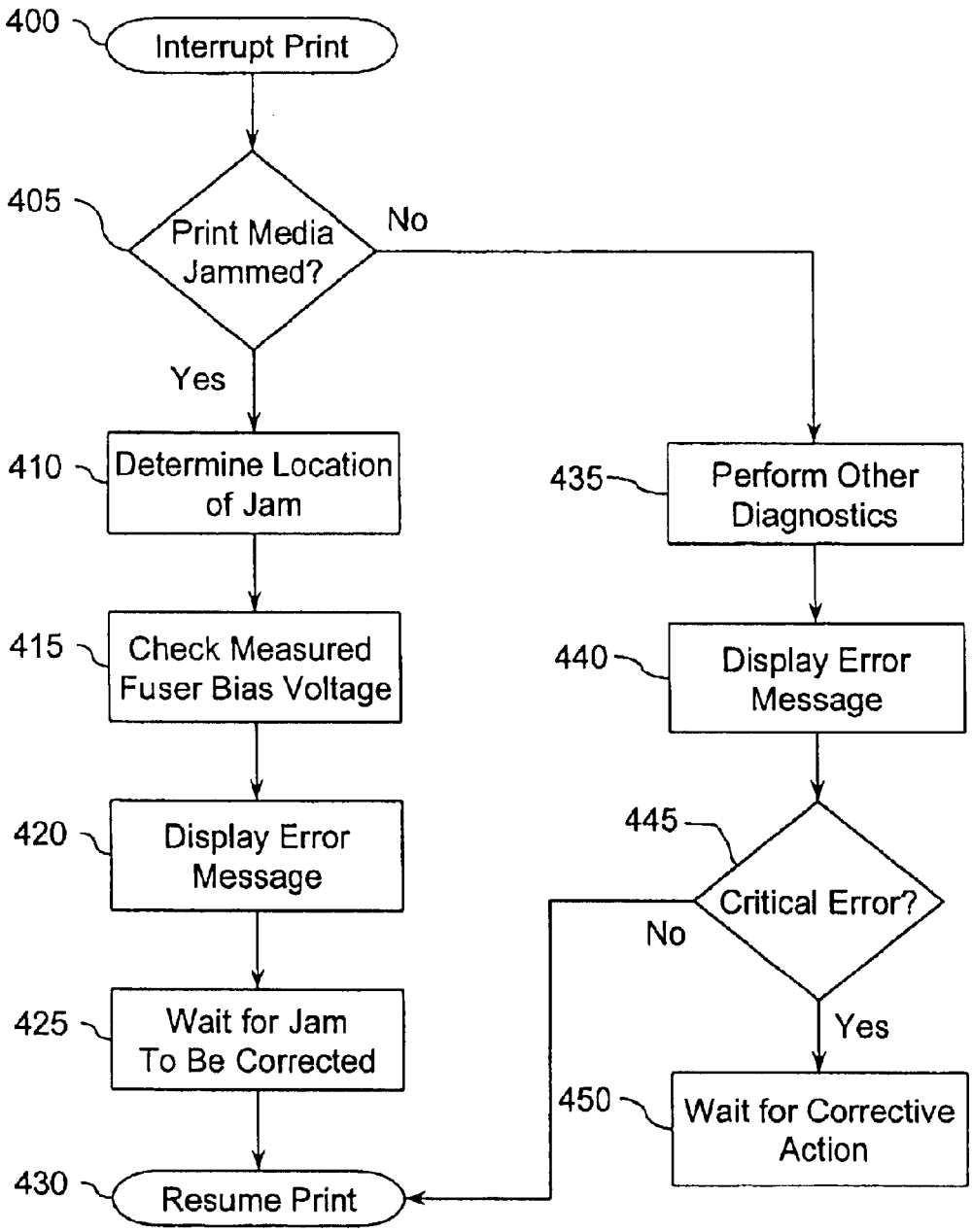
FIG. 4 is an exemplary methodology of interrupting the printing of FIG. 3 and identifying a malfunction in accordance with one embodiment of the present invention.
Figure 5:
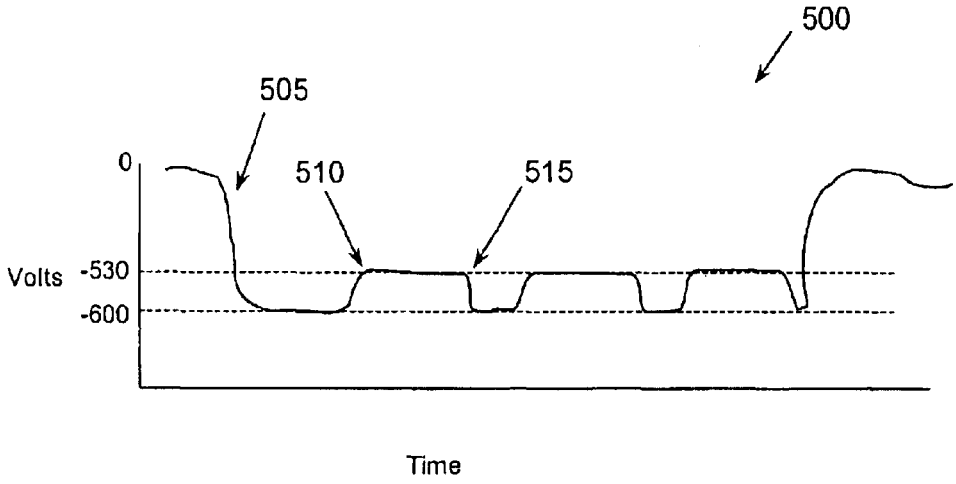
FIG. 5 is an exemplary graph showing a measured bias voltage in accordance with one embodiment of the present invention which shows different voltage states during a print job caused by the presence of print media.

With reference to FIG. 3, a flow diagram of a print process is shown. FIG. 4 shows a flow diagram of an interrupt process that is initiated when a malfunction or other error is detected during the print process. When a print request and print data are received by the electrophotographic printer 10, an image is generated and transferred to one or more sheets of print media 75 in a continuous manner (blocks 300 and 305). In this description, the print media 75 will be one or more sheets of paper. The fuser is maintained at a generally constant voltage by applying a predetermined bias voltage (block 310). However, as a sheet of paper enters the fuser, the bias voltage changes due to the current path being altered by the paper. Throughout the process, the bias voltage across the fuser is measured (block 315). An exemplary graph showing changes in the measured bias voltage is shown in FIG. 5. Based on the measured bias voltage, a fuser status signal is set (block 320) that indicates whether paper is in the fuser or not. The status signal is set, for example, by comparing the applied bias voltage to the measured voltage and setting the signal when the difference between the voltages passes a threshold.

The image is fused to the paper as it passes through the fuser with a process of heat and pressure as described above (block 325). When the sheet of paper exits the fuser, the measured bias voltage returns to the applied voltage value causing the fuser status signal to be reset indicating that the paper is not in the fuser. Each sheet is then outputted from the electrophotographic printer 10 (block 330) and the printing continues for the number of sheets required.

The controller 65 can check the fuser status signal at any desired time, along with other sensors and timing logic in the electrophotographic printer 10, to determine the location of the paper while it is moving. With this information, it can determine if the paper has reached the fuser, did not reach the fuser, exited the fuser and the like. Checking the status signal is performed, for example, with an interrupt request that spawns a software routine to check the fuser sensor circuit 140.

FIG. 4 shows an exemplary interrupt process in accordance with one embodiment of the present invention. If a malfunction or other printing error occurs during the print process, the process is interrupted (block 400). At some point during the interrupt, checks are made to determine if a paper jam has occurred (block 405). If a jam has occurred, the system turns off power so that any high voltages or currents do not injure a user who is examining the electrophotographic printer 10 and attempts to determine the location of the paper jam (block 410). As known in the art, any number of sensors can be positioned throughout the electrophotographic printer 10 to assist in detecting error conditions including sensing the presence of paper.

To determine if paper is present in the fuser, the measured fuser bias voltage is checked (block 415). This includes checking the fuser status signal which indicates whether paper is in the fuser. As described above, the status signal is set based on the measured fuser bias voltage being within a threshold of the applied bias voltage. To further assist in this determination, a fuser exit sensor may be used in conjunction with the bias voltage check to determine if a wrap jam has occurred. A wrap jam is when part of the print media 75 sticks to a fuser film and wraps around the heater/film assembly. If the location of the jam is determined, an error message is displayed which indicates the location (block 420). The message may be in the form of a visual signal, an audible signal, a text message or a combination of these. The system then waits for the jam to be corrected (block 425) before printing is resumed (block 430).

With further reference to FIG. 4, if the interrupt occurred due to an error condition other than a paper jam, other diagnostics are performed (block 435) to determine the error as known in the art. When the error condition is determined, an associated error message is displayed (block 440). If the error is critical (block 445) such that printing cannot resume, the system waits for corrective action, typically requiring human intervention, to cure the problem (block 450) before printing is resumed. Exemplary critical errors may include incorrect paper size, out of paper, out of toner, a communication error, and the like. A non-critical error which allows printing to continue may include a low toner condition.

In an alternative embodiment, FIGS. 3 and 4 represent a flow diagram showing the processing performed by the electrophotographic printer 10 as executable instructions that control the components of an imaging system. The rectangular elements denote "processing blocks" and represent computer software instructions or groups of instructions. The diamond shaped elements denote "decision blocks" and represent computer software instructions or groups of instructions which affect the execution of the computer software instructions represented by the processing blocks. Alternatively, the processing and decision blocks represent steps performed by functionally equivalent circuits such as a digital signal processor circuit or an application specific integrated circuit (ASIC). The flow diagram does not depict syntax of any particular programming language. Rather, the flow diagram illustrates the functional information one skilled in the art requires to fabricate circuits or to generate computer software to perform the processing of the system. It should be noted that many routine program elements, such as initialization of loops and variables and the use of temporary variables are not shown. It will also be appreciated by one of ordinary skill in the art that elements embodied as software may be implemented using various programming approaches such as machine language, procedural, object oriented or artificial intelligence techniques. It will further be appreciated that, if desired and appropriate, some or all of the software can be embodied as part of a device's operating system.

Illustrated in FIG. 5 is a graph 500 showing an exemplary measured bias voltage across the fuser as measured during a print cycle over time. As the printing begins, the fuser is charged 505 to a negative bias voltage of about −600 volts. As a sheet of paper enters the fuser, the paper changes the fuser bias voltage such that the measured bias voltage becomes about −530 volts. This is shown at point 510. When the sheet leaves the fuser, the measure voltage returns to the applied voltage of −600 volts (shown at point 515) since the paper is no longer interfering with the current path of the fuser. This cycle is repeated for each sheet of paper. Of course, it will be appreciated that the voltages used can be different from the values described, As long as print media 75 enters the fuser nip and changes the voltage, the changed voltage can be measured and the presence of paper can be determined.

Figure 6:
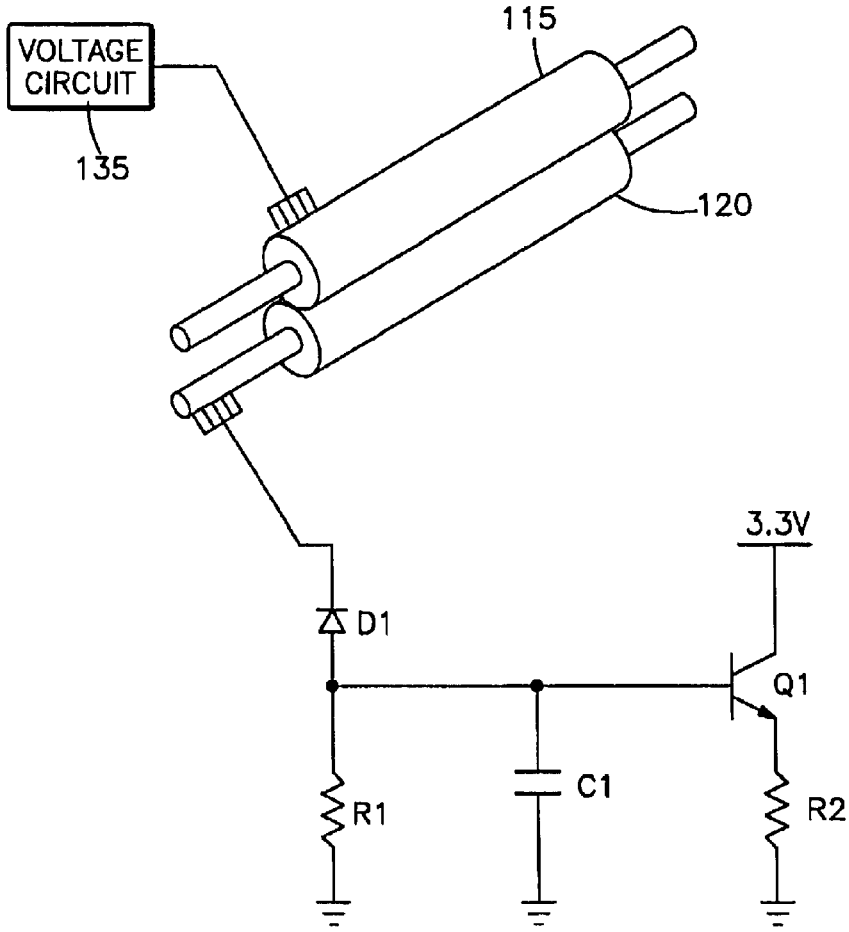
FIG. 6 is another embodiment of the fuser sensor.

Illustrated in FIG. 6 is another embodiment of the fuser sensor circuit 140 to detect a change in the bias voltage on the fuser. In one form, the circuit is connected to the fuser (for example via a carbon brush or other electrically conductive connection) and a switch Q1 turns on or off based on the bias voltage detected. The output from the switch Q1, which is considered a status signal, is read by the controller 65 or other sensor logic when desired to check its status. The switch Q1 may be a PNP transistor, an NPN transistor, a MOSFET or other type of switch. It will be appreciated that the configuration of the switch Q1, will change based on the type of bias voltage applied to the fuser and/or its polarity. This may include changing the exemplary 3.3V voltage at its collector. Thus, depending on the type of transistor, its output may be received from either the collector or emitter depending on the configuration.

Controlling the transistor's response may be a resister R1 having a resistance value that causes the switch Q1 to turn on or shut off based on the bias voltage. A diode D1 can be inserted between the circuit and the fuser to control the passage of current. The orientation of the diode D1 depends on the polarity of the bias voltage. A capacitor C1 can be included to provide a smoothing function. Optionally, a resistor R2 can be used if desired. With this circuit, as paper enters the nip of the fuser, the voltage across resister R1 changes which triggers the switch Q1 to change its state (on or off), thus changing its output status signal. This indicates that paper has entered the fuser. Of course, the circuit can be configured to cause the switch Q1 to change its status after a selected amount of voltage change has occurred such as a change that passes a threshold.

In an alternative embodiment, the fuser sensor circuit 140 is configured as a separate circuit which is not connected to the voltage circuit 135. Instead, the fuser bias voltage is measured from a film of the fuser roller 115 by, for example, a conductive brush in electrical contact with the film.

With the present invention, an imaging device can sense when paper is in the fuser by monitoring the voltage on the fuser.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

What is claimed is:

1. A method of determining a location of a print media within an electrophotographic imaging device where the print media is moved therethrough while an image is generated and transferred to the print media, the method comprising:

applying a bias voltage to a fuser to charge the fuser, the bias voltage being affected by the print media contacting the fuser;

fusing the image to the print media with the fuser;

measuring the bias voltage; and determining whether the print media is in the fuser based on the measured bias voltage.

2. The method as set forth in claim 1 wherein the applying includes applying the bias voltage at a substantially constant value.

3. The method as set forth in claim 1 wherein the determining includes generating a status signal that indicates the print media is in the fuser when the measured bias voltage differs from the applied bias voltage.

4. The method as set forth in claim 3 wherein, if the print media jams within the imaging device, displaying an error message indicating a location of the print media based on the status signal.

5. The method as set forth in claim 1 wherein the determining includes comparing the measured bias voltage to the applied bias voltage.

6. The method as set forth in claim 5 further including setting a threshold value and generating a status signal when a difference between the measured bias voltage and the applied bias voltage is greater than the threshold value.

7. The method as set forth in claim 1 wherein the measuring includes detecting a change in the measured bias voltage where the change indicates whether the print media is in the fuser.

8. The method as set forth in claim 1 wherein the measuring includes measuring the bias voltage across the fuser.

9. The method as set forth in claim 1 wherein applying the bias voltage is to reduce toner particles from being attracted to the fuser.

10. An image fusing system comprising:

a fuser including:

a fuser roller having a heating element; and a pressure roller in pressure engagement with the fuser roller where a print media passes therebetween, the fuser and pressure rollers fusing an image onto the print media through heat and pressure;

a voltage circuit for applying a bias voltage to the fuser where the bias voltage reduces toner particles from being attracted to the fuser; and a fuser sensor circuit for detecting the bias voltage of the fuser and indicating that the print media is within the fuser when the detected bias voltage changes.

11. The image fusing system as set forth in claim 10 wherein the fuser is an on-demand fuser.

12. The image fusing system as set forth in claim 10 wherein the fuser sensor circuit is connected to the voltage circuit and detects the bias voltage across the fuser.

13. The image fusing system as set forth claim 10 in wherein the fuser sensor circuit detects the bias voltage directly from the fuser.

14. The image fusing system as set forth in claim 10 further including a charging brush connected to the voltage circuit and being in contact with the fuser roller where the charging brush charges the fuser roller according to the bias voltage.

15. The image fusing system as set forth in claim 10 wherein the fuser sensor circuit includes a comparator logic that compares the detected bias voltage to the bias voltage applied and sets a status signal based on a difference therebetween.

16. The image fusing system as set forth in claim 10 wherein the fuser sensor circuit includes means for detecting a change of the bias voltage on the fuser.

* * * * *